US006320145B1

(12) United States Patent
Tai et al.

(10) Patent No.: US 6,320,145 B1
(45) Date of Patent: Nov. 20, 2001

(54) FABRICATING AND USING A MICROMACHINED MAGNETOSTATIC RELAY OR SWITCH

(75) Inventors: Yu-Chong Tai; John A. Wright, both of Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/281,756

(22) Filed: Mar. 30, 1999

Related U.S. Application Data

(60) Provisional application No. 60/080,063, filed on Mar. 31, 1998.

(51) Int. Cl.[7] ..... H01H 57/00
(52) U.S. Cl. ..... 200/181
(58) Field of Search ..... 200/181; 257/415, 257/422, 686, 428, 666, 678, 690, 734, 689

(56) References Cited

U.S. PATENT DOCUMENTS

| | | | | |
|---|---|---|---|---|
| 4,215,329 | | 7/1980 | Kobler | 335/78 |
| 4,570,139 | * | 2/1986 | Kroll | 335/187 |
| 4,997,521 | | 3/1991 | Howe et al. | 156/651 |
| 5,278,368 | * | 1/1994 | Kasano et al. | 200/181 |
| 5,475,353 | * | 12/1995 | Roshen et al. | 335/78 |
| 5,557,132 | | 9/1996 | Takahashi | 257/415 |
| 5,629,565 | * | 5/1997 | Schlaak et al. | 257/780 |
| 5,638,946 | * | 6/1997 | Zavracky | 200/181 |
| 5,666,258 | * | 9/1997 | Gevatter et al. | 361/207 |
| 5,907,269 | | 5/1999 | Zrostlik | 335/215 |

FOREIGN PATENT DOCUMENTS

3817035 * 8/1989 (DE) ..... G02B/6/24

OTHER PUBLICATIONS

Hiroshi Hosaka, et al.; Electromagnetic Microrelays: Concepts and Fundamental Characteristics; 1993; IEEE.

Joe Drake, et al.; An Electrostatically Actuated Micro–Relay; 1995; Proc. Transducers '95, Stockholm, Sweden, vol. 2, pp. 380–383.

John Wright, et al.; Magnetostatic MEMS Relays for the Miniaturization of Brushless DC Motor Controllers; Jan. 1999; MEMS '99 Conference.

* cited by examiner

*Primary Examiner*—Michael Friedhofer
(74) *Attorney, Agent, or Firm*—Fish & Richardson P.C.

(57) ABSTRACT

A micromachined magnetostatic relay or switch includes a springing beam on which a magnetic actuation plate is formed. The springing beam also includes an electrically conductive contact. In the presence of a magnetic field, the magnetic material causes the springing beam to bend, moving the electrically conductive contact either toward or away from another contact, and thus creating either an electrical short-circuit or an electrical open-circuit. The switch is fabricated from silicon substrates and is particularly useful in forming a MEMs commutation and control circuit for a miniaturized DC motor.

17 Claims, 6 Drawing Sheets

FABRICATING AND USING A MICROMACHINED MAGNETOSTATIC RELAY OR SWITCH

CROSS REFERENCE TO RELATED APPLICATIONS

This application claims the benefit of U.S. Provisional Application No. 60/080,063, filed on Mar. 31, 1998.

STATEMENT AS TO FEDERALLY SPONSORED RESEARCH

The invention described herein was made in the performance of work under a NASA contract, and is subject to the provisions of Public Law 96-517 (35 USC 202) in which the Contractor has elected to retain title.

TECHNOLOGICAL FIELD

The invention relates to miniaturization of electronic components and, in particular, to fabricating and using a micromachined magnetostatic relay or switch.

BACKGROUND

Manufacturers and users of electrical and electronic components strive to reduce the size and increase the reliability of these components and the systems in which they are used. Miniaturization of components leads to more compact and lightweight systems, which increases the range of uses for these systems and decreases the costs associated with transporting and using these systems. Improving component reliability lengthens the lifespan and enhances the performance of systems in which the components are used.

Miniaturization and reliability improvements are particularly important in areas such as space exploration and satellite communications. The cost of launching equipment from the Earth's surface is directly related to the size and weight of the equipment, and even modest reductions in equipment size produce large reductions in cost. Likewise, improving the reliability of components used in spaceborne systems extends and improves the performance of these systems, thus reducing the associated costs. In general, each newly developed generation of space oriented components and systems must meet or exceed the performance and cost standards set by previous generations.

One example of commonly used components for which size and reliability are particularly important is DC electric motors. DC motors are used widely as motive devices for linear and rotary drives in spaceborne applications. As gains have been made in the miniaturization of DC motors, the size, weight, and complexity of DC motor systems have become dominated by the commutation and control electronics that drive the motors. The disparity between the size of the motor and the size of its control electronics is particularly noticeable in a highly miniaturized motor, such as a commercially available 3-mm diameter motor, the commutation and control electronics of which are more than ten times larger than the motor itself. Even modest reductions in the power budget, complexity, mass, and volume of components such as these produce tremendous gains in the cost and reliability of spaceborne systems.

SUMMARY

In recognition of the above, the inventors have developed micromachined magnetostatic relays or switches that are highly miniaturized and highly reliable. The switches are made very small using micromachining fabrication techniques, and the materials are carefully selected to provide high reliability. The switches are useful in a wide variety of microelectronic mechanical system (MEMS) applications, particularly in the miniaturization of DC electric motors. For example, in one embodiment of the invention, the switches are used as relays in a MEMS circuit that replaces the conventional commutation and control electronics in a DC motor. This MEMS circuit is much smaller than the DC motor itself, so the size of the motor, not the size of the commutation electronics, is most critical in space constrained applications. The magnetostatic switch requires no biasing current or voltage and is useful in directly switching loads.

In one aspect, the invention features a magnetostatic switch having at least one substrate formed from a nonconductive or semiconductive material and a springing beam, such as a cantilever beam or a torsional beam, formed on the substrate. Two electrically conductive contacts define at least two switching states: (1) an open state in which the conductive contacts are physically separated from each other, and (2) a closed state in which the conductive contacts physically contact each other. One of the conductive contacts is formed on the springing beam. The springing beam includes a magnetic material which, in the presence of a magnetic field, creates an actuation force that causes the conductive contacts to switch from one of the switching states to another of the switching states.

In some embodiments, the springing beam includes a layer of material deposited onto the substrate. In other embodiments, the springing beam is formed from a portion of the substrate and is surrounded by a void left after etching away a portion of the substrate.

In some cases, one of the conductive contacts is formed on the substrate. In other cases, this conductive contact is formed on another substrate. In alternative embodiments, the springing beam is formed substantially from the magnetic material or from a nonconductive material or semiconductive material.

In other embodiments, the magnetic material is formed on a surface of the springing beam, and one of the conductive contacts is formed either on an opposing surface of the springing beam or on a surface of the magnetic material. Both normally open and normally closed versions of the switch are useful.

In another aspect, the invention involves the fabrication of a magnetostatic switch. A temporary layer of removable material is formed over a portion of a rigid substrate. A springing beam then is formed by depositing a layer of material over at least a portion of the temporary layer and over at least some portion of the substrate that is not covered by the temporary layer. The temporary layer then is removed to form a gap between the substrate and a portion of the springing beam.

In some embodiments, an electrically conductive contact layer is formed over at least a portion of the springing beam. Other embodiments include forming an electrically conductive contact layer over at least a portion of another rigid substrate, forming a patterned layer of material over a portion of the other substrate to serve as a spacing layer, and bending the two substrates to position the springing beam and the contact layer between the substrates.

Some embodiments include forming a layer of magnetic material, such as permalloy, on the springing beam. In other embodiments, the springing beam itself is formed from the magnetic material. In some of these embodiments, the electrically conductive material includes a metal, such as silver or gold, with good contact properties.

Still other embodiments include forming at least two electrically conductive areas, electrically isolated from each other, on a third substrate. The third substrate then is bonded to the other two substrates so that one of the conductive areas connects electrically to the springing beam and another of the conductive areas connects electrically to the contact layer. Electrically conductive pegs extend from the conductive areas on the third substrate and bond electrically to the other substrates.

Other embodiments and advantages will become apparent from the following description and from the claims.

DETAILED DESCRIPTION

Figure 1A:
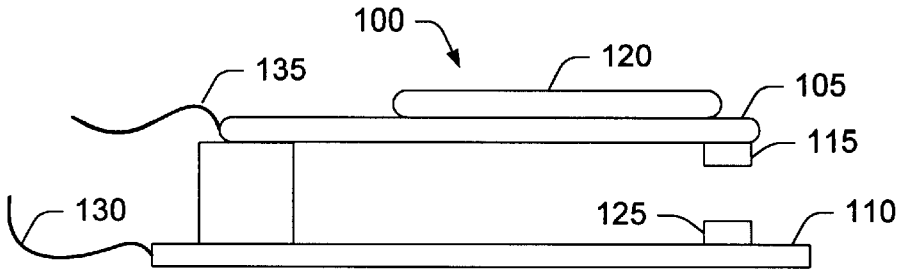
FIGS. 1A and 1B are simplified diagrams of a normally-open magnetostatic switch.
Figure 1B:
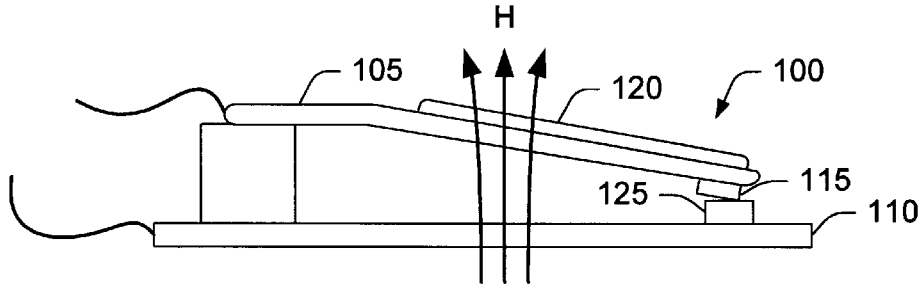

FIGS. 1A and 1B show a normally-open microelectronic mechanical system (MEMS) relay or switch 100. The switch 100 includes a cantilever beam 105 mounted on a substrate 110. For convenience, the substrate 110 is made from a substrate material, such as silicon, that is plentiful and relatively inexpensive. The substrate 110 includes an electrical contact 125 made of an electrically conductive material, such as gold or silver, with a relatively low contact resistance at modest contact forces. The cantilever beam 105 includes a magnetic actuation plate 120 which, in many embodiments, is made of a soft magnetic material with high permeability, such as permalloy ($Ni_{80}Fe_{20}$). The cantilever beam 105 also includes an electrical contact 115, which may or may not be made of the same material that forms the contact 125 on the substrate 110.

As shown in FIG. 1A, the cantilever beam 105 keeps the electrical contacts 115, 125 separated when the switch 100 is inactive, i.e., when no magnetic field is present. When an external magnetic field H appears, magnetic forces attempt to align the magnetic actuation plate 120 with the magnetic field H, causing the cantilever beam 105 to bend toward the substrate. If the strength of the magnetic field exceeds the design threshold of the switch, the electrical contacts 115, 125 touch, as shown in FIG. 1B, completing an electrical circuit through bond wires 130, 135. The electrical circuit is broken when the magnetic field disappears and the restoring force of the cantilever beam 105 separates the electrical contacts 115, 125. In alternative implementations, the cantilever beam 105 is designed to separate the contacts 115, 125 when the direction or the magnitude of the magnetic field changes.

Figure 2A:
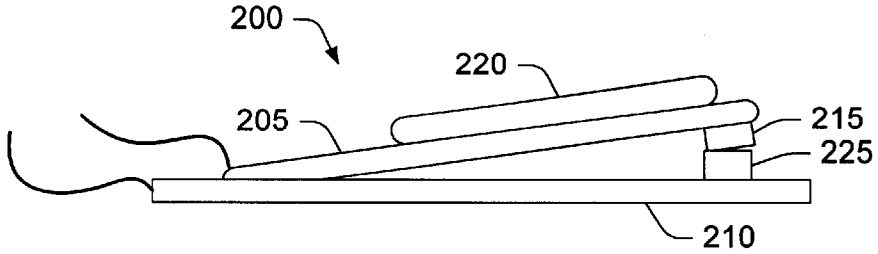
FIGS. 2A and 2B are simplified diagrams of a normally-closed magnetostatic switch.
Figure 2B:
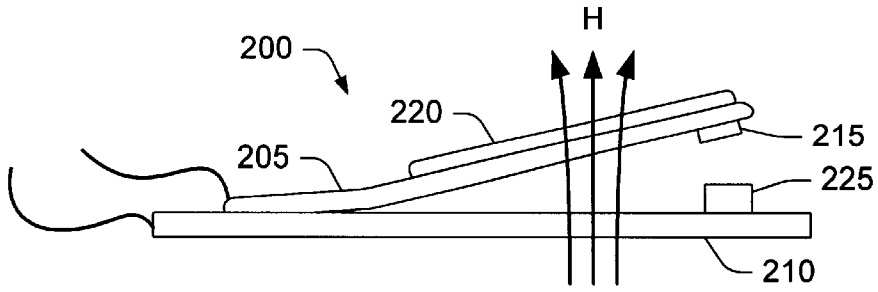

FIGS. 2A and 2B show a normally-closed MEMS switch 200 of similar structure. The cantilever beam 205 in this switch is mounted on the substrate 210 SO that the electrical contacts 215, 225 of the beam 205 and the substrate 210 are held together when the switch 200 is inactive. Applying a magnetic field to the magnetic actuator plate 220 causes the beam 205 to bend away from the substrate 210, thus separating the contacts 215, 225. The contacts 215, 225 come together again when the magnetic field disappears or, alternatively, when the direction or the magnitude of the magnetic field changes.

An alternative design for the normally closed switch resembles the normally open switch of FIG. 1A, except that the cantilever beam 105 is formed such that residual stress imparts curvature to the beam 105, holding the tip of the beam 105 against the lower electrical contact 125. In this embodiment, subjecting the beam 105 to a magnetic field creates a 105 force that opposes the residual stress in the beam 105, pulling the contacts 115, 125 apart.

Several design parameters are considered when designing micromachined magnetostatic switches like these. For a normally-open switch, these parameters include load voltage, maximum current through the switch, operating force (i.e., the force between the contacts when the switch is closed), contact closing time, and lifetime operations. Table I below shows typical values for these parameters in three types of switches: conventional electrostatic microswitches, conventional electromagnetic microswitches, and the micromachined magnetostatic switch described here. This table shows, among other things, that the micromachined magnetostatic switch produces much larger contact forces than the conventional microswitches produce, which reduces contact resistance and thus supports much larger operating currents.

| Parameter | Unit | Electrostatic Microswitch | Electromagnetic Microswitch | Micromachined Magnetostatic Switch |
|---|---|---|---|---|
| load voltage | volts | 20 | 20 | 36 |
| maximum current | mA | 0.1 | 100 | >500 |
| operating force | mN | 0.001 | 0.1 | >1 |
| contact gap | $\mu$m | 2 | >5 | >5 |
| contact closing time | $\mu$sec | 20 | 200 | <100 |
| lifetime operations | cycle | >10 million | N/A | >100 million |

In most situations, the micromachined magnetostatic switches and the systems in which they are used are designed to produce large actuation forces, which leads to several additional benefits. Larger actuation forces are present allow a stiffer cantilever beam, which leads to shorter switching time, higher g-force tolerance, and greater contact breaking force. Greater contact breaking force in turns leads to increased switching lifetime. Large actuation forces also provide the large contact forces, typically between 100 $\mu$N and 1 mN, required to yield an acceptable contact resistance when common contact materials, such as silver and gold, are used. The presence of large actuation forces also allows the switches to be designed with large gap distances between contacts, which increases device breakdown voltage.

The force generated at the free end of the cantilever beam is represented by the equation:

$$F_{bending}=M_s(WT)H\cos\theta,$$

where T=the thickness of the magnetic actuation plate 120, W=the width of the plate 120, L=the length of the plate 120, θ=the deflection angle of the beam 105 (θ=0 when the switch is inactive), H=the magnitude of the external magnetic field, and $M_s$=the saturation magnetization of the magnetic material. This equation shows that the bending force is greatest when the values of $M_s$, W, T, and H are large and the deflection angle (θ) is small. In a DC motor, the magnitude of magnetic field (H) is determined by the motor itself, and the deflection angle is determined by the desired gap distance between the contacts in the switch. In most embodiments, the gap distance between contacts and the rotation of the beam are very small, so θ≈0.

A soft magnetic material such as permalloy has a high saturation magnetization ($M_s$ greater than 0.8 Tesla), has thick plating capability, and automatically magnetizes with the desired magnetization orientation when actuated. Therefore, materials such as permalloy can be advantageous for constructing the magnetic actuation plate. Forces in excess of 5 mN are easily obtained with a permalloy actuation plate having a width of 3 mm and a thickness of 10 μm in a DC motor that produces a magnetic field strength of approximately 2500 gauss.

Figure 3A:
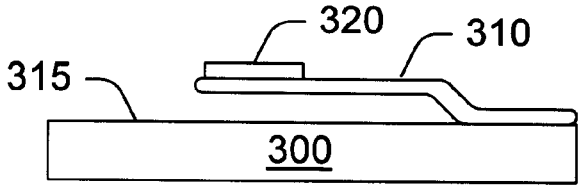
FIGS. 3A, 3B, and 3C are diagrams illustrating, in cross-section, the fabrication of a magnetostatic switch micromachined from two substrates.
Figure 3B:
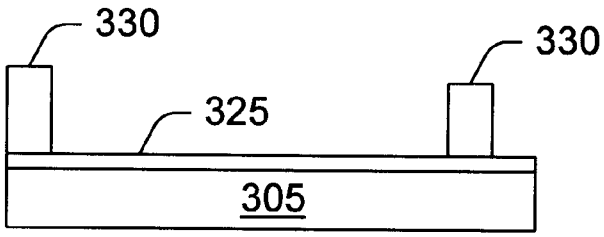
Figure 3C:
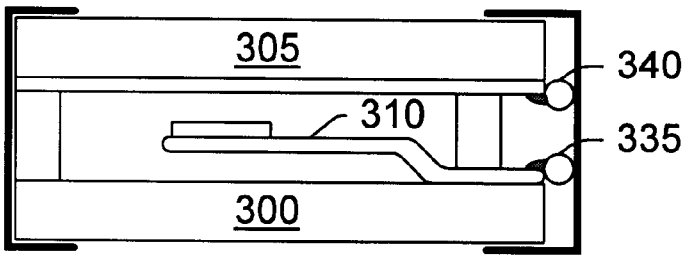

FIGS. 3A, 3B, and 3C show a magnetostatic switch micromachined from two rigid substrates 300, 305, each of which is made from a material such as silicon. The first substrate 300 (FIG. 3A) includes a magnetic actuation plate 310 formed on a surface 315 of the substrate 300. The size of the plate 310 and the materials used to form the plate 310 are determined by the factors discussed above. The plate 310 is formed over a sacrificial spacing layer (not shown here) that is deposited on a portion of the surface 315 of the substrate 300, as discussed in more detail below. After the spacing layer is removed, the plate 310 forms a cantilevered beam, a portion of which contacts the substrate 300, and the rest of which is separated from the substrate 300 by the void left by the spacing layer. An optional contact layer 320 appears on the cantilever portion of the plate 310.

The second substrate 305 (FIG. 3C) includes a contact layer 325. A permanent spacing layer 330 is deposited and patterned over a portion of the contact layer 325. Alternatively, the spacing layer 330 is formed directly on the substrate 300. The height of this spacing layer 330 is determined by the desired gap distance between the contact layers 320, 325. As shown in FIG. 3C, the substrates 300, 305 are bonded or clipped together to form a switch. One or more bond wires 335, 340 are connected to the magnetic actuation plate 310 on the first substrate 300 and to the contact layer 325 on the second substrate 305.

Figure 4A:
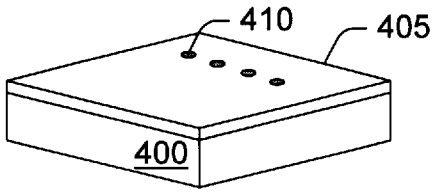
FIGS. 4A, 4B, 4C, 4D, and 4E are perspective views of a substrate at several steps of a two-substrate switch fabrication process.

FIGS. 4A through 4E show one technique for creating the magnetic actuation plate on a substrate 400. First, a sacrificial spacing layer 405 is deposited onto the substrate 400 (FIG. 4A). The spacing layer 405 is formed from an etchable material, such as photoresist. In highly miniaturized switches, the spacing layer 405 typically has a thickness of between 2 μm and 20 μm. The spacing layer 405 is patterned to form anchor holes 410, which allow the magnetic material forming the actuation plate to bond with the substrate 400 as described below. In many switches, a very thin electroplating seed layer is deposited over the spacing layer to facilitate formation of the magnetic actuation plate.

Figure 4B:
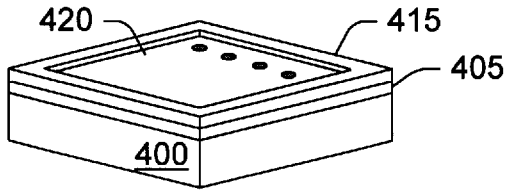
Figure 4C:
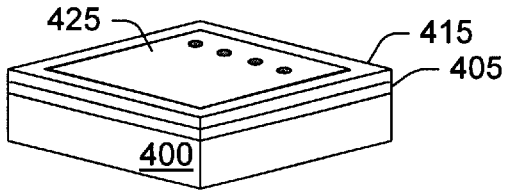

A photoresist plating mold layer 415 then is deposited over the spacing layer 405 and patterned to form a mold cavity 420 (FIG. 4B). The mold cavity 420 exposes most of the spacing layer 405, including the anchor holes 410. A magnetic material 425, such as permalloy, is deposited onto the spacing layer 405, filling the mold cavity 420 (FIG. 4C). The magnetic material 425 also fills the anchor holes 410 in the spacing layer 405, forming anchors (discussed below) that contact the substrate 400 directly. The magnetic material 425 is deposited to a thickness of between 10 μm and 20 μm in many highly miniaturized switches.

Figure 4D:
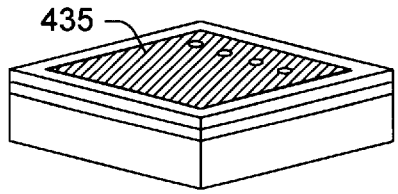
Figure 4E:
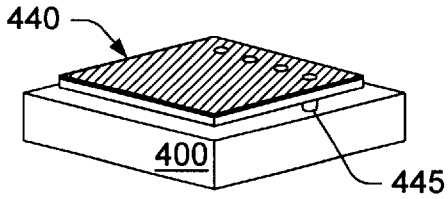

A layer of contact material 435 then is deposited over the layer of magnetic material 425 (FIG. 4D). The contact material 435 is selected from a wide range of materials with good electrical contact properties, including evaporated metals such as gold and silver. A typical thickness for the contact layer 435 is between 0.1 μm and 10 μm.

An etchant then is used to remove the photoresist mold layer 415 and spacing layer 405 from the substrate 400, leaving a magnetic actuation plate 440 mounted to the substrate 400 by anchors 445. The magnetic actuation plate 440, which includes the layers of magnetic material 425 and contact material 435, is spaced above the substrate 400 by the thickness of the stripped spacing layer 405.

Fabrication of the second substrate is carried out as shown in FIG. 3B. A layer of contact material is deposited onto a rigid substrate. A permanent spacing layer then is deposited over the contact material and patterned to avoid inhibiting the operation of the magnetic actuation plate. A wide variety of materials, such as photoresist, glass, plated metals, and plastic, are used to form the permanent spacing layer. A typical thickness for this layer is between 10 μm and 200 μm, depending on the desired operating characteristics of the switch. The two substrates then are bonded together to form an operational switch.

Figure 5A:
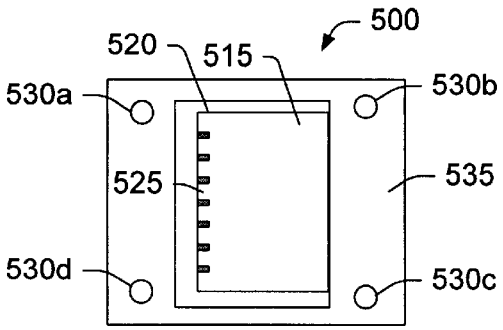
FIGS. 5A, 5B, and 5C are plan views of substrates in a three-substrate switch fabrication process.

In other embodiments, the magnetic material is deposited onto a cantilevered beam formed in the silicon substrate. One fabrication technique uses an anisotropic silicon etchant to produce a cavity in a silicon substrate frame. Etching stops just short of the opposing surface of the substrate, creating a thin silicon membrane at the bottom of the cavity. A photoresist layer then is deposited onto the membrane and patterned to form the shape of the cantilevered beam. The substrate undergoes an etching process, such as reactive ion etching (RIE), to remove all exposed portions of the membrane, leaving only a cantilevered beam connected to the substrate frame, similar to that shown in FIG. 5A and discussed below. In some cases, the cantilever beam is formed into complex shapes. For example, in one implementation the plate is attached to the substrate via torsional beams. In another implementation, one end of the plate is shaped into multiple independent fingers, as shown in FIG. 5A. The magnetic material is deposited onto the cantilevered beam using standard techniques, such as permalloy electroplating. This process allows single crystal silicon to serve as the mechanical spring material. Single crystal silicon has strength properties similar to steel without the plastic deformation limitations.

Figure 5B:
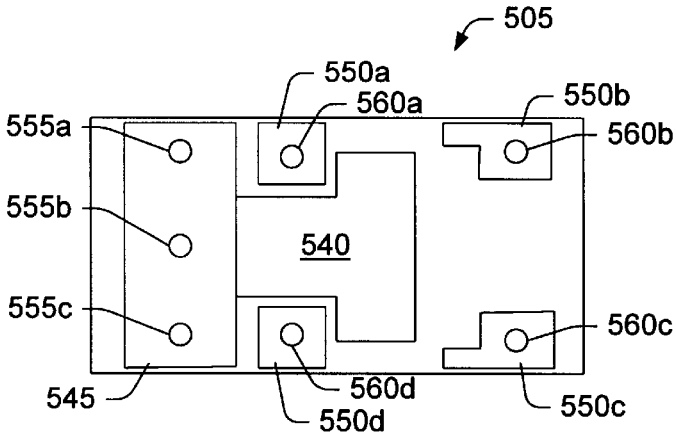
Figure 5C:
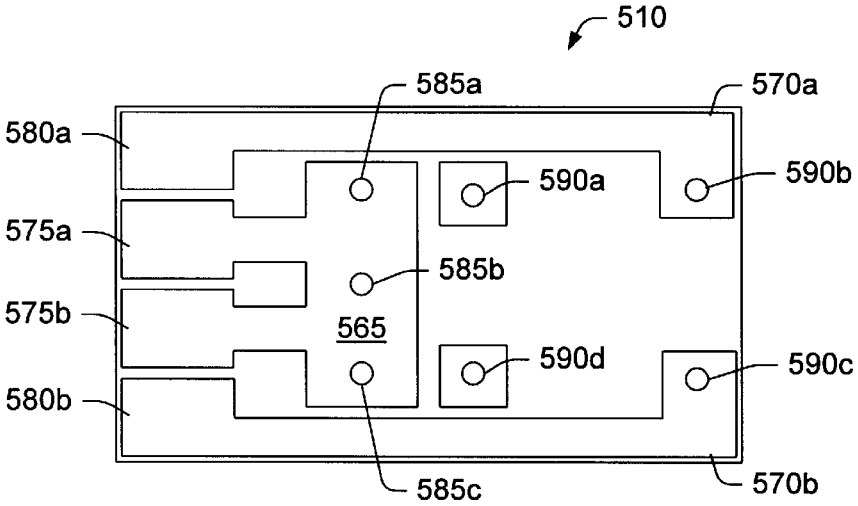

FIGS. 5A through 5C show the components of a switch fabricated from three substrates. The first substrate 500 (FIG. 5A) includes the magnetic actuation plate 515, which is formed on the surface of or as a cantilevered beam 520 in the substrate 500. Electrical contacts 525 are molded at the free end of the cantilevered beam 520. At least a portion of the substrate 500 includes a conductive layer 535 that allows electrical connection between the contact points at the end of the magnetic actuation plate 515 and at least a portion of the surrounding frame. In many switches, this conductive layer 535 is the magnetic plate itself. Alternatively, the conductive layer 535 is formed by depositing an electrical contact material, such as silver or gold, over the surface of the substrate 500. Holes or recesses 530*a–d* are formed in the substrate 500, including in the conductive area 535, to allow alignment and, in some cases, electrical contact with the other substrates.

The second substrate 505 (FIG. 5B) includes a conductive contact plate 540 that connects electrically to the magnetic actuation plate 515 only when the switch is active. The contact plate 540 often is formed from the same material as the electrical contacts 525 on the magnetic actuation plate 515, but other contact materials also are used. The second substrate 505 also includes spacers 545, 550*a–d* that provide the required physical separation between the magnetic actuation plate 515 and the contact plate 540. The spacers 545, 550*a–d* can be formed in place from nearly any material, either conductive or insulative. The spacers may also be placed manually, if desired. One approach uses a low-resistance conductive material, such as copper, that is electrodeposited onto the surface of the substrate 505 through a mold. In this implementation, at least one spacer 545 connects electrically to the contact plate 540. The remaining spacers 550*a–d* may or may not connect electrically to the magnetic actuation plate 515. Each spacer 545 that connects to the contact plate 540 is isolated electrically from the spacers that connect to the magnetic actuation plate 515. Holes 555*a–c,* 560*a–d* in the spacers allow alignment and, in some cases, electrical connectivity with the other substrates.

The third substrate 510 (FIG. 5C) serves as an output and protective layer for the switch. This substrate 510 includes two conductive areas 565, 570*a–b* that are electrically isolated from each other. One of these areas 570*a–b* connects electrically to the magnetic actuation plate 515. The other area 565 connects to the spacer 545, which is connected to the contact plate 540. The two areas 565, 570*a–b* connect electrically to each other only when the switch is active, i.e., only when the magnetic actuation plate 515 and the contact plate 540 are in contact. The conductive areas 565, 570*a–b* terminate in conductive pads 575*a–b*, 580*a–b* that allow the switch to connect to outside circuitry.

Several alignment pegs 585*a–c*, 590*a–d* extend from the conductive areas 565, 570*a–b* on this substrate 505. These pegs allow alignment with the other substrates and, in some cases, are electrically conductive to ensure electrical connectivity with the other substrates. The first substrate 500 rests directly on the third substrate, with four of the pegs 590*a–d* protruding through the holes 530*a–d* in the first substrate 500. In some cases, the pegs bond to the conductive surface 535 of the substrate 500 through a conductive bonding material, such as solder, thus connecting the magnetic actuation plate 515 to the corresponding conductive area 570*a–b* of the third substrate 510. In other applications, an insulative adhesive, such as epoxy, is used.

The second substrate 505 sits directly over the first substrate 500. One set of pegs 585*a–c* protrudes into the holes 555*a–c* in the spacer 545 that connects to the contact plate 540, thus bonding the contact plate 540 to the corresponding conductive area 565 on the third substrate 510. The other set of pegs 590*a–d* protrudes into the holes 560*a–d* in the other spacers 550*a–d*. The pegs and the spacers usually are bonded using a conductive bonding material, such as solder. The first substrate 500 and the second substrate 505 are oriented so that the magnetic actuation plate 515 touches the contact plate 540 when the switch is active.

Figure 6:
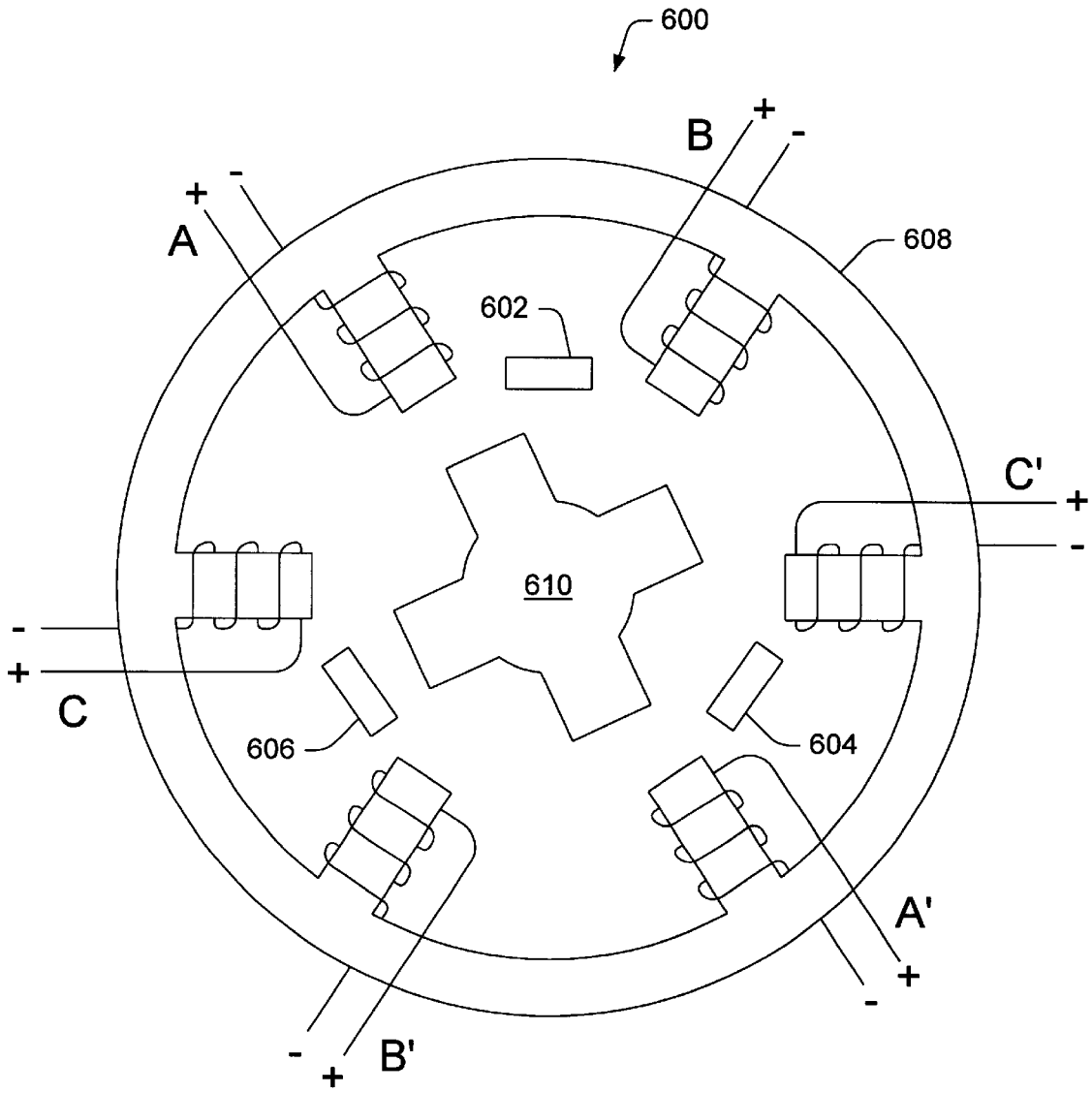
FIG. 6 is a plan view of a DC motor having a MEMS commutation circuit that uses micromachined magnetostatic switches.

FIG. 6 shows a DC motor 600 having a commutation circuit that includes micromachined magnetostatic relays 602, 604, 606 like those described above. In this example, the motor 600 is a four-pole, three-phase brushless motor having three pairs of primary and secondary windings A–A', B–B', C–C'. The windings in each pair are positioned on opposite sides of the motor housing 608 and are separated by a magnetic rotor having four poles. The relays 602, 604, 606 here are shown in relative positions in which they are spaced by angles of 120° and are placed in close proximity to stator poles. Absolute positioning of the relays 602, 604, 606, and even the number of relays, depends on the particular motor and wiring implementation with which they are used. More complex commutation techniques involving micromachined relays include H-bridge circuits, zener diode shunts, and other electronics. The particular commutation circuit used depends on the desired performance and lifetime characteristics for the motor in a particular application.

Figure 7:
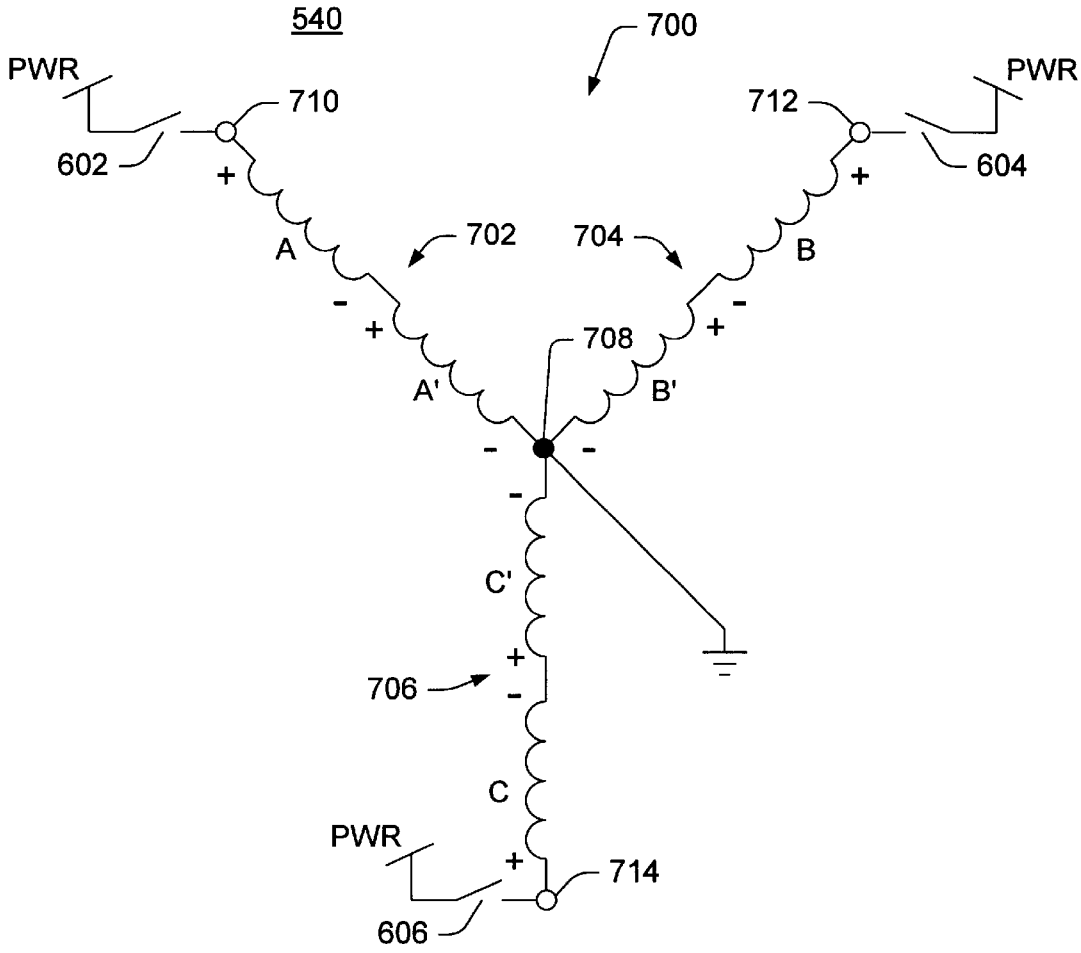
FIG. 7 is a schematic diagram of the motor windings for the DC motor of FIG. 6.

FIG. 7 is a schematic diagram showing the windings of the DC motor of FIG. 6 wired into a common "Y" or "star" configuration. The circuit 700 includes three branches 702, 704, 706 extending from a common node 708. Each of the branches includes one of the pairs of primary and secondary windings A–A', B–B', C–C', connected in series between the common node 708 and one of three power nodes 710, 712, 714. The common node 708 connects to ground. Each of the power nodes 710, 712, 714 connects to a power supply line (PWR) through one of the magnetostatic relays 602, 604, 606. The magnetostatic relays 602, 604, 606 close, and therefore apply power to the corresponding branches 702, 704, 706 of the circuit 700, each time the magnetic rotor 610 induces a magnetic field in the relays.

Other embodiments are within the scope of the following claims. For example, some embodiments of the micromachined magnetostatic switch are produced using a single-substrate fabrication technique, instead of the two-substrate and three-substrate techniques described above. Also, in many applications the switch is formed from magnetic and electrically conductive materials having properties different than the properties of those materials described above. For example, magnetic materials other than permalloy are used in applications requiring higher or lower values for the saturation magnetization of the material. Also, the magnetic material itself may be used instead of a traditional contact material to form the electrical contact when the switch is closed. In some embodiments, a springing element such as torsional beam or a helical spring is used instead of or in addition to the cantilever beam.

The micromachined magnetostatic switch is suitable for a wide range of applications other than commutation of DC motors, including virtually any application for which traditional relays and switches are used. Examples include telecommunication switching, household electronics and appliances, computers, and handheld electronics. The magnetostatic switch also is useful as a magnetic field sensor. An array of these switches designed to respond to magnetic fields of varying strengths provides very sensitive magnetic field measurements. As a result, these switches also are useful in applications previously reserved for traditional magnetic devices, such as Hall Effect sensors. The switches are useful as rotational and linear encoders, as well as in applications previously requiring reed relays.

What is claimed is:

1. A magnetostatic switch comprising:

at least one substrate formed from a nonconductive or semiconductive material;

a springing beam formed on the substrate; and two electrically conductive elements, one formed on the springing beam, that together define at least two switching states, including an open state in which the conductive elements are physically separated from each other, and a closed state in which the conductive elements physically contact each other;

wherein the springing beam includes a magnetic material which, based on a magnetic field, creates an actuation force that causes the electrically conductive elements to switch from the closed state when the actuation force is not present in which the electrically conductive elements touch one another, and are in the open state when the actuation force is present, in which the electrically conductive elements do not touch one another.

2. A magnetostatic switch comprising:

at least one substrate formed from a nonconductive or semiconductive material;

a springing beam formed on the substrate; and two electrically conductive elements, one formed on the springing beam, that together define at least two switching states, including an open state in which the conductive elements are physically separated from each other, and a closed state in which the conductive elements physically contact each other;

wherein the springing beam includes a magnetic material which, based on a magnetic field, creates an actuation force that causes the electrically conductive elements to switch from one of the switching states to another of the switching states; and wherein the conductive elements are held in the closed state by residual stress in the springing beam; and wherein the electrically conductive elements are in the closed state when the actuation force is not present.

3. A method of fabricating a magnetostatic switch, the method comprising:

forming a temporary layer of removable material over a portion of a rigid substrate;

forming a springing beam by depositing a layer of magnetic material over at least a portion of the temporary layer and over at least some portion of the substrate that is not covered by the temporary layer; and removing the temporary layer to form a gap between the substrate and a portion of the springing beam.

4. The method of claim 3, further comprising forming an electrically conductive contact layer over at least a portion of the springing beam.

5. The method of claim 3, further comprising:

forming an electrically conductive contact layer over at least a portion of another rigid substrate;

forming a patterned layer of material over a portion of the other substrate to serve as a spacing layer; and bonding the two substrates so that the springing beam and the contact layer are positioned between the substrates and are held separate from each other by the spacing layer.

6. The method of claim 5, further comprising selecting the electrically conductive material to minimize the electrical resistance between the springing beam and the contact layer.

7. The method of claim 5, wherein the electrically conductive material that forms the contact layer comprises a metal.

8. The method of claim 7, wherein the electrically conductive material comprises silver.

9. The method of claim 7, wherein the electrically conductive material comprises gold.

10. The method of claim 5, wherein the material that forms the spacing layer is electrically conductive.

11. The method of claim 10, wherein the material that forms the spacing layer comprises copper.

12. The method of claim 5, further comprising:

forming at least two electrically conductive areas, electrically isolated from each other, on a third substrate;

bonding the third substrate to the other two substrates so that one of the conductive areas connects electrically to the springing beam and another of the conductive areas connects electrically to the contact layer.

13. The method of claim 12, further comprising forming electrically conductive pegs that extend from the conductive areas on the third substrate and bond electrically to the other substrates.

14. The method of claim 3, wherein the springing beam normally touches the contact layer, and bends to release its contact to the contact layer.

15. The method of claim 3, further comprising selecting the magnetic material so that the springing beam bends to touch the contact layer in the presence of a magnetic field.

16. The method of claim 3, further comprising selecting the magnetic material to maximize saturation magnetization.

17. The method of claim 14, wherein the magnetic material comprises permalloy.

* * * * *